US007331553B2

(12) United States Patent
Kling et al.

(10) Patent No.: US 7,331,553 B2
(45) Date of Patent: Feb. 19, 2008

(54) BOTTLE SUPPORT OF COMPRESSED-AIR BOTTLES

(75) Inventors: Peter Kling, Berlin (DE); Carsten Leuschner, Berlin (DE)

(73) Assignee: MSA Auer GmbH, Berlin (DE)

( * ) Notice: Subject to any disclaimer, the term of this patent is extended or adjusted under 35 U.S.C. 154(b) by 378 days.

(21) Appl. No.: 10/276,985

(22) PCT Filed: Apr. 16, 2001

(86) PCT No.: PCT/DE01/01458

§ 371 (c)(1),
(2), (4) Date: Oct. 17, 2003

(87) PCT Pub. No.: WO01/91857

PCT Pub. Date: Dec. 6, 2001

(65) Prior Publication Data

US 2005/0035258 A1 Feb. 17, 2005

(51) Int. Cl.
*A47K 1/08* (2006.01)
*A47G 29/00* (2006.01)

(52) U.S. Cl. ..... 248/313; 248/346.01; 211/71.01; 211/88.01; 410/47; 410/49

(58) Field of Classification Search ..... 248/346.04, 248/346.03, 74.3, 219.4, 3.3, 230.7, 346.01, 248/311.2, 313, 230.1, 310; 211/74, 76, 211/85.18, 71, 88, 88.01, 71.01, 79; 206/433; 410/47, 49, 120

See application file for complete search history.

(56) References Cited

U.S. PATENT DOCUMENTS 2,149,615 A * 3/1939 McElwee ..... 248/105
2,264,489 A * 12/1941 Tiegler et al. ..... 248/694
2,379,568 A * 7/1945 Ellinwood ..... 174/40 R
2,559,317 A * 7/1951 Perlstein ..... 248/125.1
2,615,238 A * 10/1952 Highwood ..... 269/9
3,285,559 A * 11/1966 Simon ..... 248/313
3,313,372 A * 4/1967 Kilmer ..... 181/114
3,501,018 A * 3/1970 Solo ..... 211/60.1
3,784,138 A * 1/1974 Herling et al. ..... 248/96
4,023,761 A * 5/1977 Molis ..... 248/313
4,125,240 A * 11/1978 Heard ..... 248/218.4
4,213,592 A * 7/1980 Lingenfelser ..... 248/313
4,391,377 A * 7/1983 Ziaylek, Jr. ..... 211/85.18
4,685,846 A 8/1987 Golay et al. ..... 410/49
5,769,291 A * 6/1998 Chasan ..... 224/324
6,302,364 B1 * 10/2001 Chiueh ..... 248/311.2
2005/0035258 A1 * 2/2005 Kling et al. ..... 248/346.01

FOREIGN PATENT DOCUMENTS

GB 466458 5/1937
WO WO 01/91857 A1 * 6/2001

* cited by examiner

*Primary Examiner*—Carl D. Friedman
*Assistant Examiner*—Tan Le
(74) *Attorney, Agent, or Firm*—Wood, Phillips, Katz, Clark & Mortimer

(57) ABSTRACT

An apparatus for supporting a compressed-air bottle. The apparatus has a bottle support, a plurality of glide inserts projecting away from the bottle support and engageable with a compressed-air bottle supported on the apparatus, and a tightening strap for exerting a force on a compressed-air bottle supported by the apparatus. The tightening strap draws a compressed-air bottle against the glide inserts so that the glide inserts are repositioned relative to the bottle support.

8 Claims, 2 Drawing Sheets

BOTTLE SUPPORT OF COMPRESSED-AIR BOTTLES

BACKGROUND OF THE INVENTION

1. Field of the Invention

The invention relates to a bottle support for compressed-air bottles as it is commonly used on support frames. The compressed-air bottles are strapped to the bottle support and frame using a tightening strap.

2. Background Art

When compressed-air bottles are mounted using conventional structure, it is difficult to turn or move the compressed-air bottles once they rest against the bottle support. But the bottles have to be turned and moved as the fitting of the bottle valve must be aligned with the fitting of the pressure reducer to connect the compressed-air bottles; otherwise any slanted position of the bottles may cause jamming and leaking in the joint section of the bottle valve.

SUMMARY OF THE INVENTION

It is an objective of this invention to ensure that compressed-air bottles can be moved on a bottle support when they are mounted.

The inventive bottle support for compressed-air bottles that is preferably used with support frames and interposed between the bottle(s) and the support frame comprises glide inserts that project from the surface of the bottle support in the direction of the compressed-air bottles so that every filled compressed-air bottle, when not braced, is received by the frame and can be glidingly moved and that the glide inserts can be sunk in the bottle support under the action of force of a tightening strap between the compressed-air bottle and the frame and thus a simultaneous action of force on the glide inserts.

Figure 1:
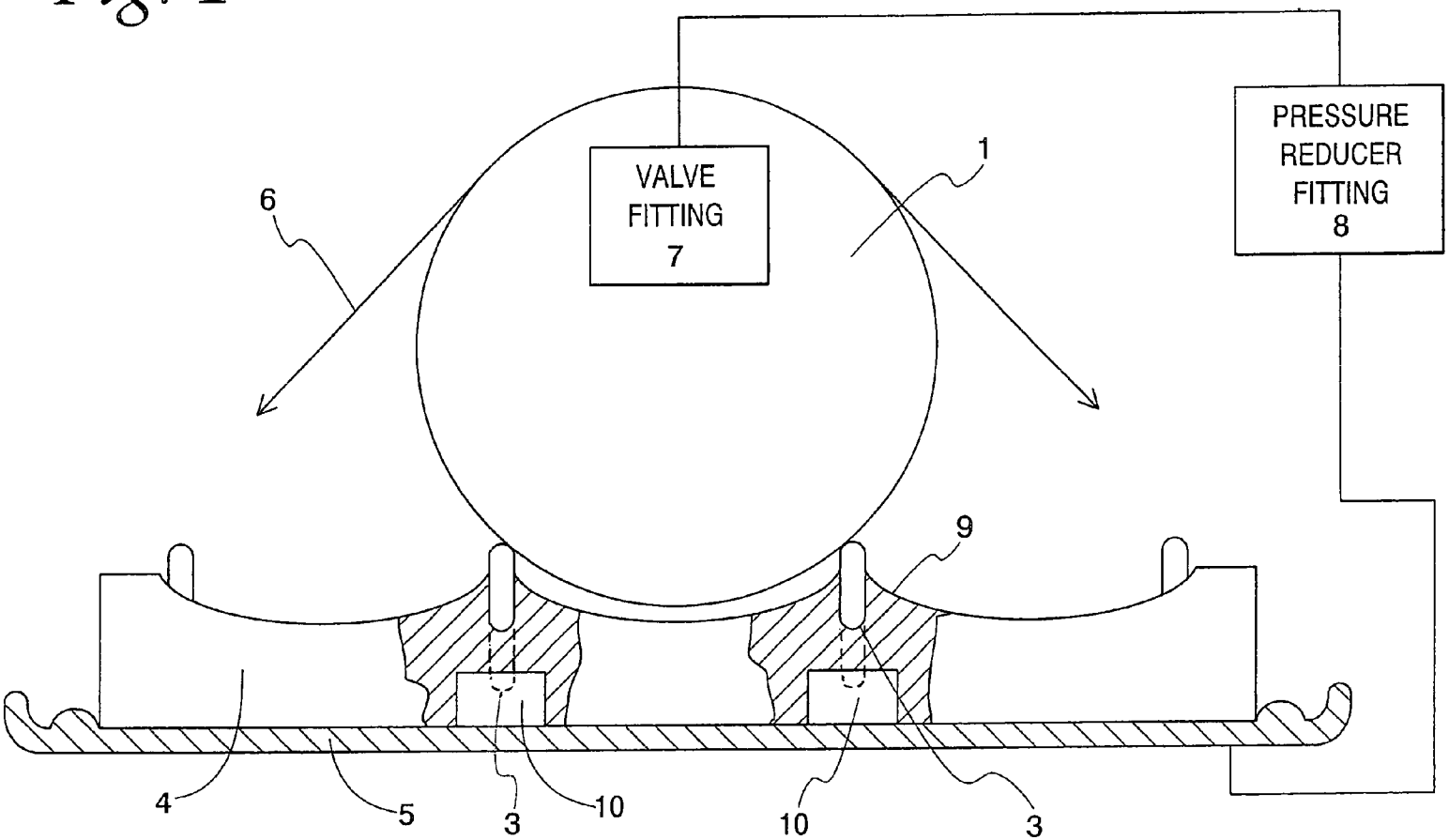
FIG. 1 is a partially schematic, partial cross-sectional view of one form of the invention, including a support frame, a bottle support with one form of glide insert, and one compressed-air bottle operatively positioned against the glides and strapped in place by a fastening strap in a position so that a valve fitting can be connected to a pressure reducer fitting on the frame.

The FIG. 1 shows a compressed-air bottle 1 that rests on glide inserts 3 of a bottle support 4. The compressed-air bottle 1 can be strapped to a support frame 5 using a tightening strap 6 when a high-pressure valve fitting 7 on the compressed-air bottle 1 and the pressure reducer fitting 8 on the frame 5 are connected. The glide inserts 3 project from the surface 9 of the bottle support 4 in the direction of the compressed-air bottle 1 so that the filled compressed-air bottle 1, when not braced, can be glidingly moved in every direction on them. Under the action of force of the tightening strap 6 on the compressed-air bottle 1 and thus on the glide inserts 3, the glide inserts can be sunk into the bottle support 4. The bottle support, which is usually made of rubber, compensates tolerances, ensures safe and nonskid tightening of the compressed-air bottles and has a shock-absorbing effect.

The force of pressure that the glide inserts 3 exert on the compressed-air bottle 1 is achieved by the resilience of the rubber bottle support 4 into which the glide inserts are firmly inserted. Hollow spaces 10 are provided underneath the glide inserts 3 in the bottle support 4. The glide inserts 3 and the adjacent material of the bottle support 4 moved into these hollow spaces 10 as a result of the tightening force of the tightening strap 6, as shown in dotted lines for one exemplary glide insert 3 in FIG. 1. The bottle support is dimensioned not only for receiving the compressed-air bottle under the tightening action but also for compressing it somewhat.

When the tightening strap 2 is loosened, the glide inserts 3 protrude due to the resilient action of the deformed portions of the bottle support 4, slightly lift the compressed-air bottle 1 and release it from the friction forces of the bottle support 4.

Figure 2:
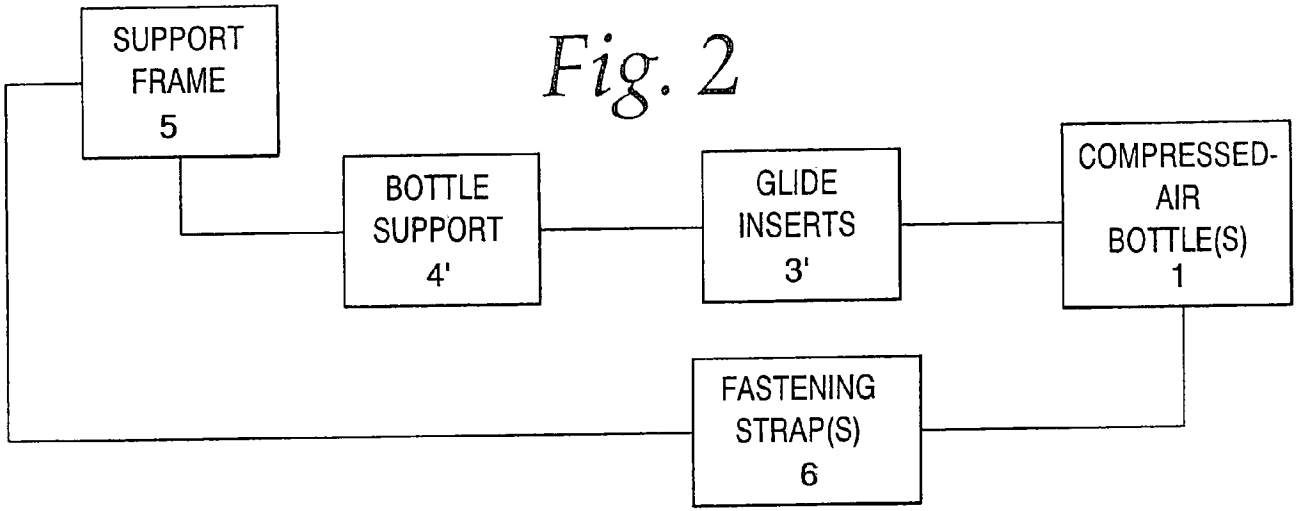
FIG. 2 is a schematic representation generically showing the cooperation between a compressed-air bottle and glide insert(s) on a bottle support on a support frame and with a fastener strap(s), as contemplated by the present invention.
Figure 3:
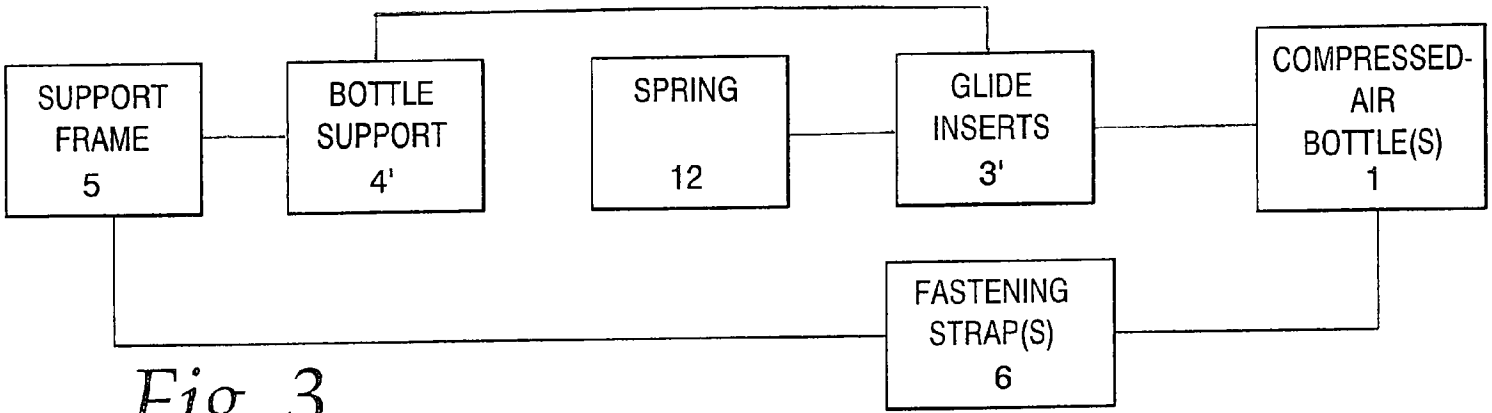
FIG. 3 is a view as in FIG. 2 wherein a spring acts against the glide inserts.

The glide inserts, as shown generally at 3' in FIG. 2, are configured as pins, knobs, buttons or ribs, at least two of the inserts acting on the periphery of one compressed-air bottle 1. They preferably consist of a synthetic material and are vulcanized, glued, or buttoned into a bottle support 4'. The fastening strap(s) 6 acts between the bottle support 4' and compressed-air bottle 1. The spring action of the compressed-air bottle is thus achieved by the bottle support alone. Also conceivable is a variant in which the glide inserts 3' are pressed against the compressed-air bottle 1 using a spring 12, as shown in FIG. 3, together with the other components of FIG. 2—the support frame 5, bottle support 4' and fastening strap(s) 6 or a combination of both designs. The glide inserts 3', as shown in FIG. 2, can also be spring-mounted parts of the support frame 5 that penetrate the bottle support 4'.

If the bottle support is made of a highly elastic material, in particular, of rubber, it has proven useful to provide the hollow spaces 10 underneath the glide inserts 3 in the bottle support 4 into which the glide inserts 3 can be sunk, as shown in FIG. 1. The glide inserts can also be sunk by being elastically bent sideways and pressed into the bottle support or a corresponding recess therein. The decisive characteristic is that the glide inserts dip far enough into the bottle support so that the elastic bottle support can compensate variations between one or more compressed-air bottle(s) strapped to it and the support frame 9.

Naturally, the invention is primarily meant for handling compressed-air bottles on support frames. But there are other fields of application and uses wherever compressed-air bottles have to be moved for alignment while resting on supports the greatest possible friction is to be produced between support and compressed-air bottle or container when the latter are braced.

The embodiment shown uses two pins that act on the periphery of a compressed-air bottle 1 as glide inserts 3. When the high-pressure fitting and the pressure reducer are disconnected, these glide inserts allow exact inserting, tilting, panning and rotational movement of the compressed-air bottle 1. This ensures that the screw fittings are in true alignment when the high-pressure fitting and the pressure reducer are connected.

We claim:

1. In combination:

a) a compressed-air bottle; and b) an apparatus for supporting the compressed-air bottle, the apparatus comprising:

a bottle support;

a plurality of glide inserts projecting away from the bottle support and engaging the compressed-air bottle supported on the apparatus; and a tightening strap that exerts a force on the compressed-air bottle that draws the compressed-air bottle against the glide inserts to thereby cause the glide inserts to reposition relative to the bottle support.

wherein the glide inserts elastically reposition relative to the bottle support under the force of the tightening strap, wherein there are hollow spaces in the bottle support, the bottle support is made of elastic material and the glide inserts deform the elastic material and sink into the hollow spaces under the force of the tightening strap.

2. The combination according to claim 1 wherein the glide inserts sink into the hollow spaces by being bent under the force of the tightening strap.

3. The combination according to claim 1 wherein the glide inserts comprise a synthetic material.

4. The combination according to claim 1 wherein the glide inserts are vulcanized, glued or buttoned into the bottle support.

5. The combination according to claim 1 wherein the apparatus comprises a support frame for attachment to a user.

6. The combination according to claim 1 wherein the compressed-air bottle has a valve fitting and the apparatus comprises a pressure reducer fitting on the support frame that is operatively connected to the valve fitting.

7. The apparatus for supporting a compressed-air bottle according to claim 1 wherein the bottle support comprises rubber.

8. In combination:

a) a compressed-air bottle; and b) an apparatus for supporting the compressed air-bottle, the apparatus comprising:

a bottle support comprising elastic material;

a plurality of glide inserts projecting away from the bottle support and engaging the compressed-air bottle supported on the apparatus, the bottle support having hollow spaces under the glide inserts; and a tightening strap that exerts a force on the compressed-air bottle that draws the compressed air-bottle against the glide inserts to thereby cause the glide inserts to reposition relative to the bottle support, whereby under the force of the tightening strap, the glide inserts elastically reposition relative to the bottle support, deform the elastic material, and sink into the hollow spaces.

* * * * *

UNITED STATES PATENT AND TRADEMARK OFFICE

CERTIFICATE OF CORRECTION

PATENT NO. : 7,331,553 B2
APPLICATION NO. : 10/276985
DATED : February 19, 2008
INVENTOR(S) : Peter Kling and Carsten Leuschner It is certified that error appears in the above-identified patent and that said Letters Patent is hereby corrected as shown below:

On the Title Page Item (30) should read,

(30) Foreign Application Priority Data

May 31, 2000 (DE) .....100 27 916.3

Signed and Sealed this
Fifteenth Day of February, 2011

David J. Kappos

David J. Kappos
*Director of the United States Patent and Trademark Office*